US005899600A

United States Patent [19]

Hockey et al.

[11] Patent Number: 5,899,600

[45] Date of Patent: May 4, 1999

[54] AIR FLOW CONTROL FOR CLEANING SYSTEM FOR REPRODUCTION APPARATUS

[75] Inventors: David E. Hockey, Brockport; Philip A. Stern, Spencerport, both of N.Y.

[73] Assignee: Eastman Kodak Company, Rochester, N.Y.

[21] Appl. No.: 08/884,898

[22] Filed: Jun. 30, 1997

[51] Int. Cl.[6] ..... G03G 21/20

[52] U.S. Cl. ..... 399/93; 399/92

[58] Field of Search ..... 399/92, 93, 98, 399/71, 355; 95/19; 96/397

[56] References Cited

U.S. PATENT DOCUMENTS

| | | | |
|---|---|---|---|
| 3,501,899 | 3/1970 | Allen | 96/397 |
| 4,093,369 | 6/1978 | Hewitt | 399/355 |
| 4,099,861 | 7/1978 | Abel . | |
| 5,028,959 | 7/1991 | Gooray | 399/93 |
| 5,087,943 | 2/1992 | Creveling | 399/93 |
| 5,117,262 | 5/1992 | Yamaguchi | 399/93 |
| 5,505,763 | 4/1996 | Reighhard et al. | 95/19 |
| 5,689,766 | 11/1997 | Hollar et al. | 399/92 |

*Primary Examiner*—S. Lee
*Attorney, Agent, or Firm*—Lawrence P. Kessler

[57] ABSTRACT

A cleaning system for an electrostatographic reproduction apparatus for air flow control for maintaining optimum cleaning efficiency. The cleaning system includes a fan for producing an air flow to entrain residual marking particles and other debris. The fan has a filter and a variable speed blower associated therewith. A pressure transducer is associated with the filter for measuring the pressure drop across the filter, and generates a signal corresponding to the pressure drop measured by the pressure transducer. Responsive to the signal from the pressure transducer, the speed of the blower is regulated to maintain a desired optimum efficiency air flow through the filter. Of course, the speed of the blower can be quantified such that at a certain threshold speed an appropriate warning may be provided that the filter is no longer operating efficiently and needs to be cleaned or replaced.

4 Claims, 1 Drawing Sheet

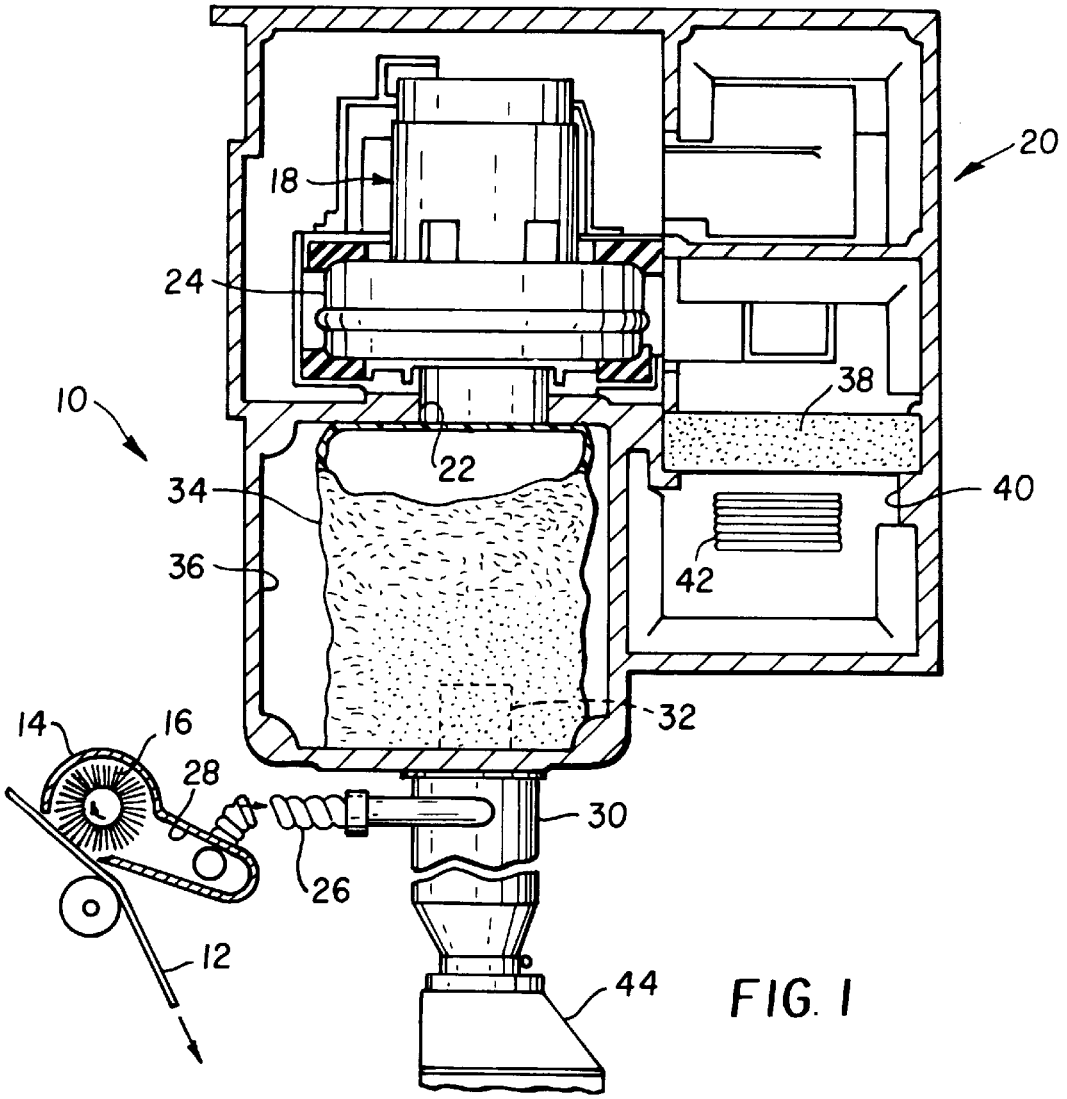
FIG. 1
FIG. 2
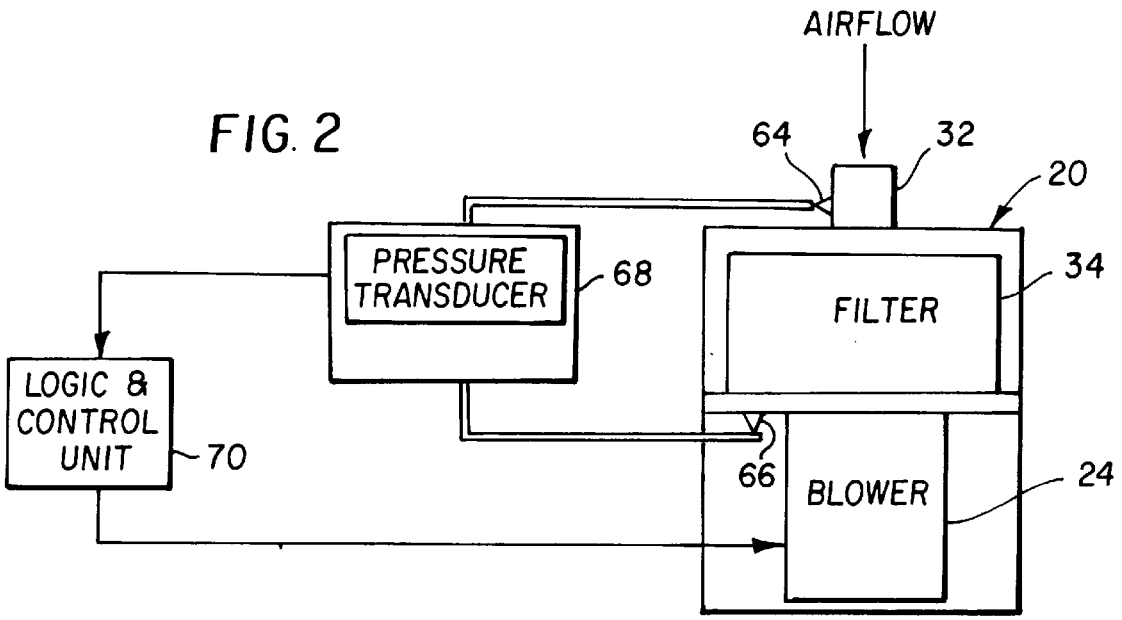

AIR FLOW CONTROL FOR CLEANING SYSTEM FOR REPRODUCTION APPARATUS

RELATED APPLICATION

This application is related to U.S. Pat. No. 5,819,137 issued Oct. 6, 1998 , entitled INTEGRATED ENVIRONMENTAL MANAGEMENT FOR REPRODUCTION APPARATUS, filed in the names of Hoffman et al, on even date herewith.

BACKGROUND OF THE INVENTION

The present invention relates in general to air flow control within a reproduction apparatus, and more particularly to an air flow control for maintaining the optimum efficiency of the cleaning system of an electrostatographic reproduction apparatus.

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

The pigmented marking particles used to develop latent image charge patterns are formed of a resinous powder generally referred to as toner. In transferring the toner to the receiver sheet, because of the nature of the particulate toner material, it is virtually impossible to make a complete transfer. If the residual toner material (and other debris) is not removed from the dielectric support member prior to reuse of the member to form subsequent images, such subsequent images formed on the member will be degraded (e.g., they will contain considerable undesirable background). Moreover, the toner material may scatter throughout the reproduction apparatus to contaminate its internal structure, thus adversely effecting its over-all operation. Accordingly, such reproduction apparatus generally include a device for cleaning residual particulate toner material (and other debris) from the dielectric support member immediately after transfer of image from the dielectric support member to the receiver member.

A typical system for cleaning the dielectric support member of a reproduction apparatus includes a rotating brush contacting the image bearing surface of the dielectric support. A vacuum atmosphere surrounds the brush and draws residual toner material and debris swept up by the brush through a filter arrangement. Over time, the filter becomes loaded with toner material and debris, and the cleaning efficiency of the system decreases. Eventually, the material captured by the filter may be blown out into the reproduction apparatus or its surrounding work space creating a hazardous condition for the machine, its operator, and the surrounding environment. One mechanism for preventing blow out is described in U.S. Pat. No. 4,099,861 (issued Jul. 11, 1978, in the name of Abel). Such mechanism provides for monitoring the cleaning apparatus of the reproduction apparatus and sensing an overload to shut down the reproduction apparatus.

The above described blow out preventing mechanism includes a light source, such as a light emitting diode (LED), placed in the exhaust path of the cleaning apparatus downstream of the filter thereof and an optical sensor positioned to view the light source. As the filter becomes loaded, particulate material permeates the filter and becomes entrained in the air flow through the exhaust path. The optical sensor produces a signal dependent upon the amount of light reaching the optical sensor. Through a comparator circuit, based upon the signal produced by the optical sensor, the concentration of particulate material in the exhaust path can be determined. At a given set point, a signal may be produced indicative of a particular concentration of toner material in the cleaning apparatus exhaust. Such signal may then be used to trigger an appropriate alarm and/or shut down the reproduction apparatus. While such mechanism is effective in preventing the blow out condition, it does not enable the cleaning apparatus to be controlled in a manner which can account for the loss in cleaning efficiency of the system less than a complete failure of the cleaning apparatus.

SUMMARY OF THE INVENTION

In view of the foregoing discussion, this invention is directed to a cleaning system for an electrostatographic reproduction apparatus, utilizing pigmented marking particles for forming copies of information to be reproduced, for air flow control for maintaining optimum cleaning efficiency. The cleaning system includes a fan for producing an air flow to entrain residual marking particles and other debris. The fan has a filter and a variable speed blower associated therewith. A pressure transducer is associated with the filter for measuring the pressure drop across the filter, and generates a signal corresponding to the pressure drop measured by the pressure transducer. Responsive to the signal from the pressure transducer, the speed of the blower is regulated to maintain a desired optimum efficiency air flow through the filter. Of course, the speed of the blower can be quantified such that at a certain threshold speed an appropriate warning may be provided that the filter is no longer operating efficiently and needs to be cleaned or replaced.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a front elevational view, in perspective, of an exemplary reproduction apparatus adapted to include the integrated environmental management system according to this invention; and FIG. 2 is a schematic illustration of the speed control for the fans of the reproduction apparatus air flow control system according to this invention;

DETAILED DESCRIPTION OF THE INVENTION

Referring now to the drawings, an exemplary cleaning apparatus 10 for removing residual particulate toner material and other debris from a moving dielectric support member 12 of an electrostatographic reproduction apparatus is shown in FIG. 1. The reproduction apparatus utilizes the pigmented marking particles to form copies of information to be reproduced. Such cleaning apparatus is described herein only to the extent necessary for a complete understanding of the instant invention, it being understood that cleaning apparatus of different configurations could be substituted without departing from the scope of this invention.

The exemplary cleaning apparatus 10 includes a housing 14 within which a bristle brush 16 is mounted for rotation. The housing 14 is located in association with the dielectric support member 12 such that the brush 16 contacts the image bearing surface of the dielectric support member. In operation, the brush is rotated in a direction such the bristles are moving in opposition to the direction of movement of the dielectric support member 12 at the point of contact with such member. The speed of the brush 16 within the housing 14 is selected to provide efficient action for sweeping of any loose particulate toner material or other debris on the dielectric support member 12 into the housing 14.

A vacuum is established within the housing 14 by a fan 18, in flow communication with the housing 14, for producing an air flow stream for removing the collected particulate material from the housing. In the illustrated cleaning apparatus 10, the fan 18 includes a blower 24 and a filter 34 mounted in a muffler box 20. The air passage between intake 22 to blower 24 of the fan 18 and the cleaning brush housing 14 includes a flexible hose 26 connected to one end to a manifold section 28 of the housing 14 and at the other end to a cyclone separator 30. The air flow from the outlet 32 of the cyclone separator 30 passes through a pleated filter 34 in the chamber 36 of the muffler box 20 and then enters the blower intake 22. The air flow from the blower 24 passes through exit ports 42 in the wall of the chamber 40.

The particulate material, collected from the dielectric support member 12 and entrained in the air flow generated by the fan 18, passes through the cyclone separator 30 wherein most of the particles (approximately 95%) are separated out of the air flow stream and fall into a toner collection bottle 44. Substantially all of the remaining entrained particulate material is removed from the air flow by the pleated filter 34. Over time, the filter collects the particulate material and becomes filled with such material. As the filter 34 fills up with collected particulate contaminate material, the pressure drop across the filter increases. As such, impedance to the air flow increases, and the system gradually becomes less efficient in removing particulate material from the air flow.

Therefore, to protect the operation of the electrostatographic reproduction apparatus and the surrounding environment, according to this invention, an air flow control is provided to maintain optimum efficiency of the cleaning apparatus. Further, the air flow control may shut the reproduction apparatus down and/or give an appropriate alarm when the cleaning system filter is no longer capable of operating efficiently and needs to be cleaned or replaced. In order to maintain maximum efficiency of the cleaning system, the air flow should be maintained within a desired range. According to this invention, the blower 24 of the fan 18 is selected to be a variable speed motor, such as for example a DC blower with analog speed control. As seen in FIG. 2, pressure ports 64, 66 are located respectively in operative association with the input and output sides of the filter 34 . A pressure transducer 68 is coupled to the pressure ports 64, 66 to measure the pressure drop across the filter. The pressure transducer 68 generates a signal corresponding to the pressure drop across the filter. A change in the pressure drop could be caused, for example, by the collection of debris in the filter or the filter becoming disconnected from the air flow system. The pressure transducer signal is transmitted to a logic and control unit 70.

The logic and control unit 70 includes a microprocessor based controller electrically coupled to the marking engine and accessories of the reproduction apparatus with which the cleaning apparatus 10 is associated. Of course, the logic and control unit may alternatively be a stand alone logic and control unit which would then, in turn, be electrically coupled to the logic and control unit of the reproduction apparatus. When the logic and control unit 70 is operative to control the electrostatographic process for the reproduction apparatus, the controller of the logic and control unit receives input signals from a typical user interface and a plurality of sensors (not shown) associated in any well known manner with the reproduction apparatus marking engine and accessories. Based on such signals and a program for the microprocessor, the logic and control unit produces appropriate signals to control the various operating devices within the reproduction apparatus. The production of a program for a number of commercially available microprocessors is a conventional skill well understood in the art, and do not form a part of this invention. The particular details of any such program would, of course, depend upon the architecture of the designated microprocessor.

In order to control the air flow to provide for maximum efficiency of operation of the cleaning apparatus 10, according to this invention the logic and control unit 70 adjusts the speed of the blower 24. Such blower speed adjustment is based on the pressure drop signal from the pressure transducer 68. The pressure drop signal is compared to a reference signal corresponding to the desired blower speed under a completely clean filter condition Filter operating at maximum cleaning efficiency). The signal difference represents the change in the filter condition (i.e., the amount of material collected in the filter and the resultant loss in cleaning efficiency). An appropriate signal is generated corresponding to the difference and produces a signal enable the logic and control unit 70 to change the blower speed accordingly. As such, the new blower speed serves to compensate for any change in impedance in the filter to maintain an optimum air flow through the filter. In addition, the level of speed increase (decrease) of the blower can be quantified such that at a certain predetermined threshold speed an appropriate warning may be provided that the filter is no longer operating efficiently and needs to be cleaned or replaced. It should also be noted that the described pressure transducer controlled blower of this invention is also suitable for use with the blower for any other filtered air flow system associated with a typical reproduction apparatus, such as for example an environmental management system for the apparatus.

The invention has been described in detail with particular reference to the preferred embodiment thereof, but it will be understood that variations and modifications can be effected within the spirit and scope of the invention as set forth in the claims.

What is claimed is:

1. An air flow control system, in association with an electrostatographic reproduction apparatus, said air flow control system comprising:

a fan for producing an air flow, a filter in the air flow causing a pressure drop in such air flow, a variable speed blower, a pressure transducer for measuring the pressure drop across said filter and generating a signal corresponding to the measured pressure drop, and a control unit, responsive to said signal from said pressure transducer for regulating the speed of said blower to maintain a desired air flow, including means for determining the speed of said blower and, at a predetermined threshold speed, providing an appropriate warning indicating that said filter is no longer operating efficiently and needs to be cleaned or replaced.

2. The air flow control system according to claim 1 wherein said variable speed blower is a DC analog speed control blower.

3. A cleaning system, in association with an electrostatographic reproduction apparatus utilizing pigmented marking particles for forming copies of information to be reproduced, for controlling air flow therethrough, said cleaning system comprising:

a fan for producing an air flow in which residual marking particles and other debris are entrained, a filter in the air flow causing a pressure drop in such air flow, a variable speed blower, a pressure transducer for measuring the pressure drop across said filter and generating a signal corresponding to the measured pressure drop, and a control unit, responsive to said signal from said pressure transducer for regulating the speed of said blower to maintain a desired air flow, including means for determining the speed of said blower and, at a predetermined threshold speed, providing an appropriate warning indicating that said filter is no longer operating efficiently and needs to be cleaned or replaced.

4. The cleaning system according to claim 3 wherein said variable speed blower is a DC analog speed control blower.

* * * * *